US011003105B2

(12) United States Patent
Sato et al.

(10) Patent No.: US 11,003,105 B2
(45) Date of Patent: May 11, 2021

(54) TONER AND TONER MANUFACTURING METHOD

(71) Applicant: CANON KABUSHIKI KAISHA, Tokyo (JP)

(72) Inventors: Masamichi Sato, Mishima (JP); Shohei Kototani, Suntou-gun (JP); Kentaro Yamawaki, Mishima (JP); Tsuneyoshi Tominaga, Suntou-gun (JP); Masatake Tanaka, Yokohama (JP); Taiji Katsura, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/728,122

(22) Filed: Dec. 27, 2019

(65) Prior Publication Data

US 2020/0209767 A1 Jul. 2, 2020

(30) Foreign Application Priority Data

Dec. 28, 2018 (JP) ..... JP2018-247162
Nov. 11, 2019 (JP) ..... JP2019-204194

(51) Int. Cl.
*G03G 9/08* (2006.01)
*G03G 9/097* (2006.01)

(52) U.S. Cl.
CPC ..... *G03G 9/09791* (2013.01); *G03G 9/0819* (2013.01); *G03G 9/09775* (2013.01)

(58) Field of Classification Search
CPC ..... G03G 9/09791; G03G 9/09775
USPC ..... 430/108.3
See application file for complete search history.

(56) References Cited

U.S. PATENT DOCUMENTS

| | | | |
|---|---|---|---|
| 7,833,685 | B2 | 11/2010 | Tanaka et al. |
| 8,372,573 | B2 | 2/2013 | Ayaki et al. |
| 8,377,616 | B2 | 2/2013 | Tani et al. |
| 8,383,313 | B2 | 2/2013 | Ayaki et al. |
| 8,551,680 | B2 | 10/2013 | Ayaki et al. |
| 8,628,899 | B2 | 1/2014 | Kawamura et al. |
| 8,815,484 | B2 | 8/2014 | Tanaka et al. |
| 9,158,216 | B2 | 10/2015 | Shimano et al. |
| 9,341,967 | B2 | 5/2016 | Tsujino et al. |
| 9,366,981 | B2 | 6/2016 | Yamawaki et al. |
| 9,377,705 | B2 | 6/2016 | Shimano et al. |
| 9,383,668 | B2 | 7/2016 | Noji et al. |
| 9,423,708 | B2 | 8/2016 | Tominaga et al. |
| 9,500,972 | B2 | 11/2016 | Tanaka et al. |
| 9,575,424 | B2 | 2/2017 | Nakagawa et al. |
| 9,599,919 | B2 | 3/2017 | Isono et al. |
| 9,632,441 | B2 | 4/2017 | Abe et al. |
| 9,658,549 | B2 | 5/2017 | Tanaka et al. |
| 9,720,340 | B2 | 8/2017 | Tominaga et al. |
| 9,733,583 | B2 | 8/2017 | Kuroki et al. |
| 9,733,584 | B2 | 8/2017 | Masumoto et al. |
| 9,785,071 | B2 | 10/2017 | Shimano et al. |
| 9,785,077 | B2 | 10/2017 | Abe et al. |
| 9,829,816 | B2 | 11/2017 | Tanaka et al. |
| 9,829,820 | B2 | 11/2017 | Masumoto et al. |
| 9,835,964 | B2 | 12/2017 | Yoshida et al. |
| 9,897,932 | B2 | 2/2018 | Hotta et al. |
| 9,904,193 | B2 | 2/2018 | Nakagawa et al. |
| 9,921,501 | B2 | 3/2018 | Mochizuki et al. |
| 9,958,801 | B2 | 5/2018 | Tanaka et al. |
| 10,054,866 | B2 | 8/2018 | Tanaka et al. |
| 10,114,303 | B2 | 10/2018 | Katsura et al. |
| 10,429,757 | B2 | 10/2019 | Yoshida et al. |
| 10,503,090 | B2 | 12/2019 | Tominaga et al. |
| 10,545,422 | B2 | 1/2020 | Yamawaki et al. |
| 2004/0058258 | A1 | 3/2004 | Yoshino et al. |
| 2004/0137356 | A1 | 7/2004 | Tomita et al. |
| 2008/0226998 | A1 | 9/2008 | Ishii et al. |
| 2009/0117477 | A1 | 5/2009 | Magome et al. |
| 2009/0155706 | A1 | 6/2009 | Shu et al. |
| 2010/0035171 | A1 | 2/2010 | Watanabe et al. |
| 2010/0248110 | A1 | 9/2010 | Taguchi et al. |
| 2014/0220488 | A1 | 8/2014 | Hosoya et al. |
| 2014/0356779 | A1 | 12/2014 | Hasegawa et al. |
| 2015/0248072 | A1 | 9/2015 | Katsuta et al. |
| 2016/0187799 | A1 | 6/2016 | Hiroshi et al. |
| 2016/0299446 | A1 | 10/2016 | Kuroki et al. |
| 2017/0219947 | A1 | 8/2017 | Omori et al. |
| 2017/0329246 | A1 | 11/2017 | Yamawaki et al. |
| 2018/0329323 | A1 | 11/2018 | Kimura et al. |
| 2018/0329324 | A1 | 11/2018 | Kamikura et al. |
| 2018/0329327 | A1 | 11/2018 | Yamawaki et al. |
| 2018/0329329 | A1 | 11/2018 | Nakamura et al. |
| 2019/0332024 | A1 | 10/2019 | Umeda et al. |

(Continued)

FOREIGN PATENT DOCUMENTS

| | | |
|---|---|---|
| EP | 0 430 076 | 6/1991 |
| EP | 2 669 740 | 12/2013 |

(Continued)

OTHER PUBLICATIONS

U.S. Appl. No. 16/728,050, Tsuneyoshi Tominaga, filed Dec. 27, 2019.
U.S. Appl. No. 16/728,060, Kentaro Yamawaki, filed Dec. 27, 2019.
U.S. Appl. No. 16/728,082, Yasuhiro Hashimoto, filed Dec. 27, 2019.
U.S. Appl. No. 16/728,101, Taiji Katsura, filed Dec. 27, 2019.
U.S. Appl. No. 16/728,115, Shotaru Nomura, filed Dec. 27, 2019.
U.S. Appl. No. 16/728,151, Masatake Tanaka, filed Dec. 27, 2019.
U.S. Appl. No. 16/728,157, Shohei Kototani, filed Dec. 27, 2019.

(Continued)

*Primary Examiner* — Mark A Chapman
(74) *Attorney, Agent, or Firm* — Venable LLP

(57) ABSTRACT

A toner including a toner particle containing a binder resin and an external additive, wherein the external additive contains composite particles of an organosilicon polymer fine particle and a fatty acid metal salt.

8 Claims, No Drawings

(56) References Cited

U.S. PATENT DOCUMENTS

| | | | | |
|---|---|---|---|---|
| 2020/0026208 | A1 | 1/2020 | Terui et al. | |
| 2020/0026209 | A1 | 1/2020 | Yagi et al. | |
| 2020/0124998 | A1 | 4/2020 | Kototani et al. | |
| 2020/0124999 | A1 | 4/2020 | Tanaka et al. | |
| 2020/0150555 | A1* | 5/2020 | Ikada ..... | G03G 15/065 |

FOREIGN PATENT DOCUMENTS

| | | |
|---|---|---|
| EP | 2 818 932 | 12/2014 |
| EP | 2 853 945 | 4/2015 |
| EP | 2 860 585 | 4/2015 |
| EP | 3 095 805 | 11/2016 |
| EP | 3 480 661 | 5/2019 |
| JP | 2017-219823 | 12/2017 |
| JP | 2018-054705 | 4/2018 |
| WO | 2018/003749 | 1/2018 |

OTHER PUBLICATIONS

U.S. Appl. No. 16/728,171, Takaaki Furui, filed Dec. 27, 2019.
U.S. Appl. No. 16/728,179, Koji Nishikawa, filed Dec. 27, 2019.
U.S. Appl. No. 16/670,352, Kentaro Yamawaki, filed Oct. 31, 2019.

* cited by examiner

TONER AND TONER MANUFACTURING METHOD

BACKGROUND OF THE INVENTION

Field of the Invention

The present invention relates to a toner for use in image-forming methods such as electrophotographic methods, and to a manufacturing method thereof.

Description of the Related Art

In electrophotographic methods, a latent image bearing member is first charged by various means, and then exposed to light to form an electrostatic latent image on the surface of the latent image bearing member. The electrostatic latent image is then developed with a toner to form a toner image, which is then transferred to a transfer material such as paper where it is fixed by application of heat, pressure, or heat and pressure to obtain a copied article or print.

In such an image-forming process, the toner remaining on the surface of the latent image bearing member after toner image transfer is removed with a cleaning blade. However, because friction occurs between the cleaning blade and the surface of the latent image bearing member, the cleaning performance may decline due to wear of the member during long-term use, potentially causing image defects due to incompletely cleaned toner or additives. Efforts have therefore been made to add lubricant particles to the toner with aim of reducing friction between the latent image bearing member and the cleaning blade.

Recently in particular, a toner containing both positively-charged and negatively-charged lubricant particles is proposed in Japanese Patent Application Publication No. 2017-219823, while Japanese Patent Application Publication No. 2018-54705 discloses a toner containing a composite of a lubricant particle and a particle having reverse polarity to the lubricant particle, and these have provided effects that are not obtained by adding a simple lubricant.

Japanese Patent Application Publication No. 2017-219823 proposes a toner containing both a positively charged lubricant particle and a negatively charged lubricant particle. Because the positively charged lubricant particle and negatively charged lubricant particle adhere to the latent image portion and the non-latent image portion of the latent image bearing member surface, respectively, they provide good cleaning performance not dependent on stroke rate.

Japanese Patent Application Publication No. 2018-54705 proposes a toner containing a composite of a lubricant particle and a particle having reverse polarity to the lubricant particle. A feature of this composite is that it comprises both a positively charged composite and a negatively charged composite, and this feature can also be used to control color streaks even during image output after passage of an image having a clearly demarcated image portion and non-image portion.

SUMMARY OF THE INVENTION

In the invention of Japanese Patent Application Publication No. 2017-219823, however, it has been found that lubricant particles that have accumulated between the cleaning blade and the surface of the latent image bearing member from formation of multiple images slip around the cleaning blade and cause contamination of the member in situations in which impact is applied such as when restarting the cartridge, causing image defects called startup streaks.

Moreover, because the toner of Japanese Patent Application Publication No. 2018-54705 uses a hard silica particle as one of the particles, silica particles entered in the cleaning blade nip scratch the surface of the latent image bearing member each time printing is applied, causing image defects called vertical streaks.

The present invention provides a toner that solves these problems. Specifically, the present invention provides a toner whereby slippage of not only toner but also external additives around the cleaning blade does not occur even during cartridge restart, and whereby good toner cleaning performance is maintained without damage to the latent image bearing member surface over the long term, together with a manufacturing method therefor.

The inventors discovered as a result of exhaustive research that these issues could be resolved with the following toner.

That is, the present invention relates to a toner including:

a toner particle containing a binder resin, and an external additive, wherein the external additive contains composite particles of an organosilicon polymer fine particle and a fatty acid metal salt.

With the present invention it is possible to obtain a toner whereby slippage of not only toner but also external additives around the cleaning blade does not occur even during cartridge restart, and whereby good toner cleaning performance is maintained without damage to the latent image bearing member surface over the long term.

Further features of the present invention will become apparent from the following description of exemplary embodiments.

DESCRIPTION OF THE EMBODIMENTS

Unless otherwise specified, descriptions of numerical ranges such as "from XX to YY" or "XX to YY" in the present invention include the numbers at the upper and lower limits of the range.

To suppress slippage of toner and external additives around the cleaning blade, it is effective to increase the density of the external additive deposition layer (hereunder called the blocking layer) that forms at the point of contact between the latent image bearing member surface and the cleaning blade (hereunder called the cleaning blade nip) so that this layer is not broken down even after long-term use. However, as the blocking layer becomes denser it also becomes harder, and is more likely to cause image defects called vertical streaks by damaging the surface of the latent image bearing member.

The inventors therefore conducted exhaustive research aimed at making the blocking layer both highly dense and flexible. Specifically, we investigated external additives combining organosilicon polymer fine particles with fatty acid metal salts that are used as lubricant particles.

Since organosilicon polymer fine particles generally have elasticity, we expected that they could deform inside the blocking layer to fill in the gaps in the layer, thereby forming a highly dense blocking layer while maintaining flexibility. We found that a fatty acid metal salt and an organosilicon polymer fine particle functioned better as a blocking layer when composites of each were formed in the cleaning blade nip. Furthermore, we found that when the blocking layer uses an organosilicon polymer fine particle having elasticity, it has the additional property of not damaging the surface of the latent image bearing member.

We then discovered as the result of additional research aimed at improving performance that when a composite particle was formed in advance from a fatty acid metal salt and an organosilicon polymer fine particle and externally added to the toner instead of externally adding the fatty acid metal salt and organosilicon polymer fine particle separately, it was easier to form the blocking layer with the composite, and both high density and flexibility of the blocking layer were further successfully achieved.

The following two points are being considered as reasons why these effects are obtained with the composite. First, it is thought that when a composite is used from the beginning, a blocking layer can be formed by the composite when the composite enters the cleaning blade nip. Second, the positive charging performance is weakened when the surface of the positively charged fatty acid metal salt is covered with the organosilicon polymer fine particle to form the composite particle, so the composite fine particle is more likely to move from the negatively charged toner particle surface to the surface of the latent image bearing member, and is therefore easier to supply to the cleaning blade nip.

An organosilicon polymer fine particle can also be used to improve toner flowability, but if too much is added it can cause cleaning blade slippage and contamination of the member. However, it was found that with a toner such as that of the present invention containing composite particles of a fatty acid metal salt and an organosilicon polymer fine particle, contamination of the member can be prevented even when using a large amount of the organosilicon polymer fine particle. This improvement in cleaning performance is attributed to formation of the blocking layer as discussed above.

Thus, the inventors discovered that slippage of not only the toner but also of the external additive around the cleaning blade was less likely even during cartridge startup and good cleaning performance could be maintained without damaging the surface of the latent image bearing member during long-term use with a toner containing composite particles of a fatty acid metal salt and an organosilicon polymer fine particle.

Specifically, the toner according to the invention is a toner including:

a toner particle containing a binder resin, and an external additive, wherein the external additive contains composite particles of an organosilicon polymer fine particle and a fatty acid metal salt.

The present invention is explained in detail below. A composite particle of a fatty acid metal salt and an organosilicon polymer fine particle is used as an external additive in the present invention. In the invention, a composite particle of a fatty acid metal salt and an organosilicon polymer fine particle is a particle comprising an organosilicon polymer fine particle adhering to the surface of a fatty acid metal salt.

The toner can be observed with an electron microscope to confirm adherence of the organosilicon polymer fine particle. From an image taken under an electron microscope, the area of the fatty acid metal salt and the area of organosilicon polymer fine particle adhering to the surface of the fatty acid metal salt (total area when there are multiple particles adhering) are measured, and the area ratio of the two is calculated and given as the coverage ratio of the fatty acid metal salt by the organosilicon polymer fine particle. Specific methods of measuring the coverage ratio are explained in detail below.

In the present invention, in observation of the composite particle under a scanning electron microscope, a coverage ratio of a surface of the fatty acid metal salt by the organosilicon polymer fine particle is preferably from 1% by area to 40% by area, or more preferably from 10% by area to 40% by area.

If the coverage ratio is at least 1% by area, it is easy to form a highly dense and flexible blocking layer from the composite particle, and contamination of the member is prevented. If it is not more than 40% by area, slippage of the organosilicon polymer fine particle around the cleaning blade is prevented during initial formation of the blocking layer, and contamination of the member is prevented because the proportion of the organosilicon polymer fine particle relative to the composite particle is appropriate.

To cover the surface of the fatty acid metal salt with the organosilicon polymer fine particle with a coverage ratio of the fatty acid metal salt surface by the organosilicon polymer fine particle within the above range, it is desirable to use an organosilicon polymer fine particle with a smaller particle diameter than that of the fatty acid metal salt.

Given A (nm) as the number-average particle diameter of the primary particles of the organosilicon polymer fine particle and B (nm) as the number-average particle diameter of the primary particles of the fatty acid metal salt, the ratio of A to B (AB) is preferably from 0.01 to 0.50, or more preferably from 0.05 to 0.30.

The proportion of the composite particles having the coverage ratio of from 1% by area to 40% by area is preferably from 70 number % to 100 number %, or more preferably from 80 number % to 100 number % of the total composite particles. The total composite particles here exclude the fatty acid metal salt by itself or individual organosilicon polymer fine particles that have not formed composite particles.

This number % is controlled by controlling the particle diameter ratio (A/B) within the above range, and also by controlling the ratio (C/D) of the added amount C (mass parts) of the fatty acid metal salt and the added amount D (mass parts) of the organosilicon polymer fine particle. (C/D) is preferably from 0.01 to 0.50, or more preferably from 0.03 to 0.30.

If the percentage is at least 70 number %, the cleaning performance improves because there is little variation in the coverage ratio of the composite particle, resulting in formation of a uniform blocking layer on the cleaning blade.

The organosilicon polymer fine particle has a structure of alternately bonded silicon atoms and oxygen atoms, and part of the organosilicon polymer preferably has a T3 unit structure represented by $R^aSiO_{3/2}$. $R^a$ is preferably a hydrocarbon group, and more preferably a $C_{1-6}$ (preferably $C_{1-3}$, more preferably $C_{1-2}$) alkyl group or phenyl group.

In $^{29}$Si-NMR measurement of the organosilicon polymer fine particle, a ratio of area of a peak derived from silicon having the T3 unit structure relative to a total area of peaks derived from all silicon elements contained in the organosilicon polymer fine particle is preferably from 0.50 to 1.00, or more preferably from 0.90 to 1.00.

The method of manufacturing the organosilicon polymer fine particle is not particularly limited, and for example it can be obtained by dripping a silane compound into water, hydrolyzing it with a catalyst and performing a condensation reaction, after which the resulting suspension is filtered and dried. The particle diameter can be controlled by means of the type and compounding ratio of the catalyst, the reaction initiation temperature, and the dripping time and the like.

Examples of the catalyst include, but are not limited to, acidic catalysts such as hydrochloric acid, hydrofluoric acid, sulfuric acid, nitric acid and the like, and basic catalysts such as ammonia water, sodium hydroxide, potassium hydroxide and the like.

The organosilicon compound for producing the organosilicon polymer fine particle is explained below.

The organosilicon polymer is preferably a polycondensate of an organosilicon compound having a structure represented by the following formula (Z):

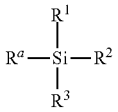

(Z)

(in formula (Z), $R^a$ represents an organic functional group, and each of $R_1$, $R_2$ and $R_3$ independently represents a halogen atom, hydroxyl group or acetoxy group, or a (preferably $C_{1-3}$) alkoxy group).

$R^a$ is an organic functional group without any particular limitations, but preferred examples include $C_{1-6}$ (preferably $C_{1-3}$, more preferably $C_{1-2}$) hydrocarbon groups (preferably alkyl groups) and aryl (preferably phenyl) groups.

Each of $R_1$, $R_2$ and $R_3$ independently represents a halogen atom, hydroxyl group, acetoxy group or alkoxy group. These are reactive groups that form crosslinked structures by hydrolysis, addition polymerization and condensation. Hydrolysis, addition polymerization and condensation of $R_1$, $R_2$ and $R_3$ can be controlled by means of the reaction temperature, reaction time, reaction solvent and pH. An organosilicon compound having three reactive groups ($R_1$, $R_2$ and $R_3$) in the molecule apart from $R_a$ as in formula (Z) is also called a trifunctional silane.

Examples of formula (Z) include the following:

trifunctional methylsilanes such as p-styryl trimethoxysilane, methyl trimethoxysilane, methyl triethoxysilane, methyl diethoxymethoxysilane, methyl ethoxydimethoxysilane, methyl trichlorosilane, methyl methoxydichlorosilane, methyl ethoxydichlorosilane, methyl dimethoxychlorosilane, methyl methoxyethoxychlorosilane, methyl diethoxychlorosilane, methyl triacetoxysilane, methyl diacetoxymethoxysilane, methyl diacetoxyethoxysilane, methyl acetoxydimethoxysilane, methyl acetoxymethoxyethoxysilane, methyl acetoxydiethoxysilane, methyl trihydroxysilane, methyl methoxydihydroxysilane, methyl ethoxydihydroxysilane, methyl dimethoxyhydroxysilane, methyl ethoxymethoxyhydroxysilane and methyl diethoxyhydroxysilane; trifunctional ethylsilanes such as ethyl trimethoxysilane, ethyl triethoxysilane, ethyl trichlorosilane, ethyl triacetoxysilane and ethyl trihydroxysilane; trifunctional propylsilanes such as propyl trimethoxysilane, propyl triethoxysilane, propyl trichlorosilane, propyl triacetoxysilane and propyl trihydroxysilane; trifunctional butylsilanes such as butyl trimethoxysilane, butyl triethoxysilane, butyl trichlorosilane, butyl triacetoxysilane and butyl trihydroxysilane; trifunctional hexylsilanes such as hexyl trimethoxysilane, hexyl triethoxysilane, hexyl trichlorosilane, hexyl triacetoxysilane and hexyl trihydroxysilane; and trifunctional phenylsilanes such as phenyl trimethoxysilane, phenyl triethoxysilane, phenyl trichlorosilane, phenyl triacetoxysilane and phenyl trihydroxysilane. These organosilicon compounds may be used individually, or two or more kinds may be combined.

The following may also be used in combination with the organosilicon compound having the structure represented by formula (Z): organosilicon compounds having four reactive groups in the molecule (tetrafunctional silanes), organosilicon compounds having two reactive groups in the molecule (bifunctional silanes), and organosilicon compounds having one reactive group in the molecule (monofunctional silanes). Examples include:

dimethyl diethoxysilane, tetraethoxysilane, hexamethyl disilazane, 3-aminopropyl trimethoxysilane, 3-aminopropyl triethoxysilane, 3-(2-aminoethyl)aminopropyl trimethoxysilane, 3-(2-aminoethyl)aminopropyl triethoxysilane, and trifunctional vinyl silanes such as vinyl triisocyanatosilane, vinyl trimethoxysilane, vinyl triethoxysilane, vinyl diethoxymethoxysilane, vinyl ethoxydimethoxysilane, vinyl ethoxydihydroxysilane, vinyl dimethoxyhydroxysilane, vinyl ethoxymethoxyhydroxysilane and vinyl diethoxyhydroxysilane.

The content of the structure represented by formula (Z) in the monomers forming the organosilicon polymer is preferably at least 50 mol %, or more preferably at least 60 mol %.

The content of the organosilicon polymer fine particle is preferably from 0.5 mass parts to 10.0 mass parts, or more preferably from 1.0 mass part to 8.0 mass parts per 100 mass parts of the toner particle. If the content is at least 0.5 mass parts, the cleaning performance improves because the coverage ratio of the fatty acid metal salt surface by the organosilicon polymer fine particle is better. If it is not more than 10.0 mass parts, contamination of the member from the external additive is prevented.

The number-average particle diameter of the primary particles of the organosilicon polymer fine particle is preferably from 0.02 μm to 0.35 μm, or more preferably from 0.05 μm to 0.2 μm. If it is at least 0.02 μm, the coverage ratio by the organosilicon polymer fine particle can be controlled appropriately. If it is not more than 0.35 μm, toner flowability is good.

A known fatty acid metal salt may be used, without any particular limitations. Examples include calcium stearate, zinc stearate, magnesium stearate, aluminum stearate, lithium stearate, sodium stearate, calcium montanate, zinc montanate, magnesium montanate, aluminum montanate, lithium montanate, sodium montanate, calcium behenate, zinc behenate, magnesium behenate, lithium behenate, sodium behenate, calcium laurate, zinc laurate, barium laurate, lithium laurate and the like.

Of these, the fatty acid metal salt preferably includes zinc stearate, and more preferably is zinc stearate.

A known method may be adopted as the method for manufacturing the fatty acid metal salt, without any particular limitations. Examples include a method of dripping a solution of an inorganic metal compound into a solution of an alkali metal salt of a fatty acid, and reacting the two (double decomposition method), and a method of kneading and reacting a fatty acid and an inorganic metal compound at a high temperature (dissolution method). To reduce variation between particles of the fatty acid salt, a wet manufacturing method is preferred, and double decomposition is especially preferred. This manufacturing process includes a step of dripping a solution of an inorganic metal compound into a solution of an alkali metal salt of a fatty acid to thereby replace the alkali metal of the fatty acid with the metal of the inorganic metal compound.

The content of the fatty acid metal salt is preferably from 0.05 mass parts to 1.0 mass part, or more preferably from 0.1 mass parts to 0.5 mass parts per 100 mass parts of the toner particle. If it is at least 0.05 mass parts, the amount of the composite is appropriate, and the cleaning performance improves. If it is not more than 1.0 mass part, contamination of the member by the external additive is prevented.

The number-average particle diameter of the primary particles of the fatty acid metal salt is preferably from 0.15 μm to 2.0 μm, or more preferably from 0.3 μm to 2.0 μm, or still more preferably from 0.5 μm to 1.5 μm. If it is at least 0.15 μm, the coverage ratio by the organosilicon polymer fine particle can be controlled within the range of the invention. If it is not more than 2.0 μm, the toner flowability is improved.

The method of including the composite particle of the organosilicon polymer fine particle and fatty acid metal salt in the toner as an external additive is not particularly limited, but for example the organosilicon polymer fine particle and fatty acid metal salt may be mixed and stirred in advance to form a composite particle before being externally added to the toner particle, and the formed composite particle can then be externally added to the toner particle.

The mixer for advance mixing may be for example a blender mixer (Oster), FM mixer (Nippon Coke & Engineering Co., Ltd.), super mixer (Kawata Mfg. Co., Ltd.), Nobilta (Hosokawa Micron Corporation), hybridizer (Nara Machinery Co., Ltd.) or the like. In the present invention, the organosilicon polymer fine particle and fatty acid metal salt may also be present individually on the toner particle separately from the composite particle.

The rotation and mixing time of the mixer can be adjusted appropriately according to the type of mixer to optimize the coverage ratio of the composite particle.

The number ratio of the composite particle is preferably at least 0.001 particles, or more preferably at least 0.005 particles per one particle of the toner particle. From the standpoint of toner flowability, the upper limit is preferably not more than 1.000 particle, or more preferably not more than 0.500 particles.

The content of the composite particle is not particularly limited, but is preferably 0.01 mass parts to 3.0 mass parts or more preferably 0.1 mass parts to 1.0 mass part per 100 mass parts of the toner particle.

Another external additive may also be used to improve toner performance. In this case, the external additives including the composite particles are preferably contained in the total amount of 0.5 mass parts to 15.0 mass parts per 100 mass parts of the toner particle. If the total amount of the external additive particles is not less than 0.5 mass parts, the toner flowability is improved. If the total amount of the external additive particles is not more than 15.0 mass parts, contamination of the member from the external additive is prevented.

The method of manufacturing the toner according to the invention is not particularly limited, but preferably includes the steps of: mixing an organosilicon polymer fine particle with a fatty acid metal salt to obtain composite particles, and externally adding the resulting composite particles to the toner particle.

The mixer for adding the external additive to the toner particle is not particularly limited, and a known dry or wet mixer may be used. Examples include the FM mixer (Nippon Coke & Engineering Co., Ltd.), super mixer (Kawata Mfg. Co., Ltd.), Nobilta (Hosokawa Micron Corporation), hybridizer (Nara Machinery Co., Ltd.) and the like.

The sieving apparatus used for sorting out coarse particles after external addition may be an Ultrasonic (Koei Sangyo Co., Ltd.); Resona Sieve or Gyro-Sifter (Tokuju Co., Ltd.); Vibrasonic System (Dalton Corporation); Soniclean (Sintokogio, Ltd.); Turbo Screener (Freund-Turbo Corporation); Microsifter (Makino Mfg. Co., Ltd.) or the like.

The method for manufacturing the toner particle is explained. The toner particle manufacturing method is not particularly limited, and a known method may be used, such as a kneading pulverization method or wet manufacturing method. A wet method is preferred for obtaining a uniform particle diameter and controlling the particle shape. Examples of wet manufacturing methods include suspension polymerization methods dissolution suspension methods, emulsion polymerization aggregation methods, emulsion aggregation methods and the like, and an emulsion aggregation method may be used by preference in the present invention.

In emulsion aggregation methods, a fine particle of a binder resin and a fine particle of another material such as a colorant as necessary are dispersed and mixed in an aqueous medium containing a dispersion stabilizer. A surfactant may also be added to this aqueous medium. A flocculant is then added to aggregate the mixture until the desired toner particle size is reached, and the resin fine particles are also melt adhered together either after or during aggregation. Shape control with heat may also be performed as necessary in this method to form a toner particle.

The fine particle of the binder resin here may be a composite particle formed as a multilayer particle comprising two or more layers composed of different resins. For example, this can be manufactured by an emulsion polymerization method, mini-emulsion polymerization method, phase inversion emulsion method or the like, or by a combination of multiple manufacturing methods.

When the toner particle contains an internal additive, the internal additive may be included in the resin fine particle. A liquid dispersion of an internal additive fine particle consisting only of the internal additive may also be prepared separately, and the internal additive fine particle may then be aggregated together with the resin fine particle. Resin fine particles with different compositions may also be added at different times during aggregation, and aggregated to prepare a toner particle composed of layers with different compositions.

The following may be used as the dispersion stabilizer:

inorganic dispersion stabilizers such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

Other examples include organic dispersion stabilizers such as polyvinyl alcohol, gelatin, methyl cellulose, methyl hydroxypropyl cellulose, ethyl cellulose, carboxymethyl cellulose sodium salt, and starch.

A known cationic surfactant, anionic surfactant or nonionic surfactant may be used as the surfactant.

Specific examples of cationic surfactants include dodecyl ammonium bromide, dodecyl trimethylammonium bromide, dodecylpyridinium chloride, dodecylpyridinium bromide, hexadecyltrimethyl ammonium bromide and the like.

Specific examples of nonionic surfactants include dodecylpolyoxyethylene ether, hexadecylpolyoxyethylene ether, nonylphenylpolyoxyethylene ether, lauryl polyoxyethylene ether, sorbitan monooleate polyoxyethylene ether, styrylphenyl polyoxyethylene ether, monodecanoyl sucrose and the like.

Specific examples of anionic surfactants include aliphatic soaps such as sodium stearate and sodium laurate, and sodium lauryl sulfate, sodium dodecylbenzene sulfonate, sodium polyoxyethylene (2) lauryl ether sulfate and the like.

The binder resin constituting the toner is explained next.

Preferred examples of the binder resin include vinyl resins, polyester resins and the like. Examples of vinyl resins, polyester resins and other binder resins include the following resins and polymers:

monopolymers of styrenes and substituted styrenes, such as polystyrene and polyvinyl toluene; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; and polymethyl methacryalte, polybutyl methacrylate, polvinyl acetate, polyethylene, polypropylene, polvinyl butyral, silicone resin, polyamide resin, epoxy resin, polyacrylic resin, rosin, modified rosin, terpene resin, phenol resin, aliphatic or alicyclic hydrocarbon resins and aromatic petroleum resins.

The binder resin preferably contains a vinyl resin, and more preferably contains a styrene copolymer. These binder resins may be used individually or mixed together.

The binder resin preferably contains carboxyl groups, and is preferably a resin manufactured using a polymerizable monomer containing a carboxyl group. Examples include vinylic carboxylic acids such as acrylic acid, methacrylic acid, α-ethylacrylic acid and crotonic acid; unsaturated dicarboxylic acids such as fumaric acid, maleic acid, citraconic acid and itaconic acid; and unsaturated dicarboxylic acid monoester derivatives such as monoacryloyloxyethyl succinate ester, monomethacryloyloxyethyl succinate ester, monoacryloyloxyethyl phthalate ester and monomethacryloyloxyethyl phthalate ester.

Polycondensates of the carboxylic acid components and alcohol components listed below may be used as the polyester resin. Examples of carboxylic acid components include terephthalic acid, isophthalic acid, phthalic acid, fumaric acid, maleic acid, cyclohexanedicarboxylic acid and trimellitic acid. Examples of alcohol components include bisphenol A, hydrogenated bisphenols, bisphenol A ethylene oxide adduct, bisphenol A propylene oxide adduct, glycerin, trimethyloyl propane and pentaerythritol.

The polyester resin may also be a polyester resin containing a urea group. Preferably the terminal and other carboxyl groups of the polyester resins are not capped.

To control the molecular weight of the binder resin constituting the toner particle, a crosslinking agent may also be added during polymerization of the polymerizable monomers.

Examples include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinyl benzene, bis (4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester diacrylate (MANDA, Nippon Kayaku Co., Ltd.), and these with methacrylate substituted for the acrylate.

The added amount of the crosslinking agent is preferably from 0.001 mass parts to 15.000 mass parts per 100 mass parts of the polymerizable monomers.

The toner may also contain a release agent. In particular, a plasticization effect is easily obtained using an ester wax with a melting point of from 60° C. to 90° C. because the wax is highly compatible with the binder resin.

Examples of ester waxes include waxes consisting primarily of fatty acid esters, such as carnauba wax and montanic acid ester wax; fatty acid esters in which the acid component has been partially or fully deacidified, such as deacidified carnauba wax; hydroxyl group-containing methyl ester compounds obtained by hydrogenation or the like of plant oils and fats; saturated fatty acid monoesters such as stearyl stearate and behenyl behenate; diesterified products of saturated aliphatic dicarboxylic acids and saturated fatty alcohols, such as dibehenyl sebacate, distearyl dodecanedioate and distearyl octadecanedioate; and diesterified products of saturated aliphatic diols and saturated aliphatic monocarboxylic acids, such as nonanediol dibehenate and dodecanediol distearate.

Of these waxes, it is desirable to include a bifunctional ester wax (diester) having two ester bonds in the molecular structure.

A bifunctional ester wax is an ester compound of a dihydric alcohol and an aliphatic monocarboxylic acid, or an ester compound of a divalent carboxylic acid and a fatty monoalcohol.

Specific examples of the aliphatic monocarboxylic acid include myristic acid, palmitic acid, stearic acid, arachidic acid, behenic acid, lignoceric acid, cerotic acid, montanic acid, melissic acid, oleic acid, vaccenic acid, linoleic acid and linolenic acid.

Specific examples of the fatty monoalcohol include myristyl alcohol, cetanol, stearyl alcohol, arachidyl alcohol, behenyl alcohol, tetracosanol, hexacosanol, octacosanol and triacontanol.

Specific examples of the divalent carboxylic acid include butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecaendioic acid, tetradecanedioic acid, hexadecanedioic acid, octadecanedioic acid, eicosanedioic acid, phthalic acid, isophthalic acid, terephthalic acid and the like.

Specific examples of the dihydric alcohol include ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexane dimethanol, spiroglycol, 1,4-phenylene glycol, bisphenol A, hydrogenated bisphenol A and the like.

Other release agents that can be used include petroleum waxes and their derivatives, such as paraffin wax, microcrystalline wax and petrolatum, montanic wax and its derivatives, hydrocarbon waxes obtained by the Fischer-Tropsch method, and their derivatives, polyolefin waxes such as polyethylene and polypropylene, and their derivatives, natural waxes such as carnauba wax and candelilla wax, and their derivatives, higher fatty alcohols, and fatty acids such as stearic acid and palmitic acid.

The content of the release agent is preferably from 5.0 mass parts to 20.0 mass parts per 100.0 mass parts of the binder resin.

A colorant may also be included in the toner. The colorant is not specifically limited, and the following known colorants may be used.

Examples of yellow pigments include yellow iron oxide, Naples yellow, naphthol yellow S, Hansa yellow G, Hansa yellow 10G, benzidine yellow G, benzidine yellow GR, quinoline yellow lake, permanent yellow NCG, condensed azo compounds such as tartrazine lake, isoindolinone compounds, anthraquinone compounds, azo metal complexes, methine compounds and allylamide compounds. Specific examples include:

C.I. pigment yellow 12, 13, 14, 15, 17, 62, 74, 83, 93, 94, 95, 109, 110, 111, 128, 129, 147, 155, 168 and 180.

Examples of red pigments include red iron oxide, permanent red 4R, lithol red, pyrazolone red, watching red calcium salt, lake red C, lake red D, brilliant carmine 6B, brilliant carmine 3B, eosin lake, rhodamine lake B, condensed azo compounds such as alizarin lake, diketopyrrolopyrrole compounds, anthraquinone compounds, quinacridone compounds, basic dye lake compounds, naphthol compounds, benzimidazolone compounds, thioindigo compound and perylene compounds. Specific examples include:

C.I. pigment red 2, 3, 5, 6, 7, 23, 48:2, 48:3, 48:4, 57:1, 81:1, 122, 144, 146, 166, 169, 177, 184, 185, 202, 206, 220, 221 and 254.

Examples of blue pigments include alkali blue lake, Victoria blue lake, phthalocyanine blue, metal-free phthalocyanine blue, phthalocyanine blue partial chloride, fast sky blue, copper phthalocyanine compounds such as indathrene blue BG and derivatives thereof, anthraquinone compounds and basic dye lake compounds. Specific examples include:

C.I. pigment blue 1, 7, 15, 15:1, 15:2, 15:3, 15:4, 60, 62 and 66.

Examples of black pigments include carbon black and aniline black. These colorants may be used individually, or as a mixture, or in a solid solution.

The content of the colorant is preferably from 3.0 mass parts to 15.0 mass parts per 100.0 mass parts of the binder resin.

The toner particle may also contain a charge control agent. A known charge control agent may be used. A charge control agent that provides a rapid charging speed and can stably maintain a uniform charge quantity is especially desirable.

Examples of charge control agents for controlling the negative charge properties of the toner particle include:

organic metal compounds and chelate compounds, including monoazo metal compounds, acetylacetone metal compounds, aromatic oxycarboxylic acids, aromatic dicarboxylic acids, and metal compounds of oxycarboxylic acids and dicarboxylic acids. Other examples include aromatic oxycarboxylic acids, aromatic mono- and polycarboxylic acids and their metal salts, anhydrides and esters, and phenol derivatives such as bisphenols and the like. Further examples include urea derivatives, metal-containing salicylic acid compounds, metal-containing naphthoic acid compounds, boron compounds, quaternary ammonium salts and calixarenes.

Meanwhile, examples of charge control agents for controlling the positive charge properties of the toner particle include nigrosin and nigrosin modified with fatty acid metal salts; guanidine compounds; imidazole compounds; quaternary ammonium salts such as tributylbenzylammonium-1-hydroxy-4-naphthosulfonate salt and tetrabutylammonium tetrafluoroborate, onium salts such as phosphonium salts that are analogs of these, and lake pigments of these; triphenylmethane dyes and lake pigments thereof (using phosphotungstic acid, phosphomolybdic acid, phosphotungstenmolybdic acid, tannic acid, lauric acid, gallic acid, ferricyanic acid or a ferrocyan compound or the like as the laking agent); metal salts of higher fatty acids; and resin charge control agents.

One of these charge control agents alone or a combination of two or more may be used. The added amount of these charge control agents is preferably from 0.01 mass parts to 10.0 mass parts per 100.0 mass parts of the binder resin.

The methods of measuring the various physical properties of the toner according to the invention are explained below.

Method for Identifying Composite Particle Comprising Organosilicon Polymer Fine Particle Covering Surface of Fatty Acid Metal Salt The composite particle comprising the organosilicon polymer fine particle covering the surface of the fatty acid metal salt can be identified by a combination of shape observation by scanning electron microscopy (SEM) and elemental analysis by energy dispersive X-ray analysis (EDS). In detail, the composite particle can be identified by the organosilicon polymer fine particle identification method and fatty acid metal salt identification method described below.

Organosilicon Polymer Fine Particle Identification Method

The organosilicon polymer fine particle contained in the toner can be identified by a method combining shape observation by SEM with elemental analysis by EDS.

The toner is observed in a field enlarged to a maximum magnification of 50000× with a scanning electron microscope (trade name: "S-4800", Hitachi, Ltd.). The microscope is focused on the toner particle surface, and the external additive is observed. Each particle of the external additive is subjected to EDS analysis to determine whether or not the analyzed particle is an organosilicon polymer fine particle based on the presence or absence of an Si element peak.

When the toner contains both an organosilicon polymer fine particle and a silica fine particle, the ratio of the elemental contents (atomic %) of Si and O (Si/O ratio) is compared with that of a standard product to identify the organosilicon polymer. Standard products of both the organosilicon polymer fine particle and silica fine particle are subjected to EDS analysis under the same conditions, to determine the elemental contents (atomic %) of Si and O. The Si/O ratio of the organosilicon polymer fine particle is given as A, and the Si/O ratio of the silica fine particle as B. Measurement conditions are selected such that A is significantly larger than B. Specifically, the standard products are measured 10 times under the same conditions, and arithmetic means are obtained for both A and B. The measurement conditions are selected so that the arithmetic means yield an AB ratio greater than 1.1.

If the Si/O ratio of an evaluated fine particle is closer to A than to [(A+B)/2], the fine particle is judged to be an organosilicon polymer fine particle.

Tospearl 120A (Momentive Performance Materials Japan LLC) is used as the standard product for the organosilicon polymer fine particle, and HDK V15 (Asahi Kasei Corporation) as the standard product for the silica fine particle.

Method for Identifying Compositions and Ratios of Constituent Compounds of Organosilicon Polymer Fine Particle (Measuring Ratio of T3 Unit Structures)

The compositions and ratios of the constituent compounds of the organosilicon polymer fine particle contained in the toner are identified by NMR.

When the toner contains a silica fine particle in addition to the organosilicon polymer fine particle, 1 g of the toner is dissolved and dispersed in 31 g of chloroform in a vial. This is dispersed for 30 minutes with an ultrasound homogenizer to prepare a liquid dispersion.

Ultrasonic processing unit: VP-050 ultrasound homogenizer (Taitec Corporation)

Microchip: Step microchip, tip diameter φ 2 mm

Microchip tip position: Center of glass vial and 5 mm above bottom of vial

Ultrasound conditions: Intensity 30%, 30 minutes; ultrasound is applied while cooling the vial with ice water so that the temperature of the dispersion does not rise.

The dispersion is transferred to a swing rotor glass tube (50 mL), and centrifuged for 30 minutes under conditions of 58.33 $S^{-1}$ with a centrifuge (H-9R; Kokusan Co., Ltd.). After centrifugation, the glass tube contains silica fine particles with heavy specific gravity in the lower layer. The chloroform solution containing organic silica polymer fine particles in the upper layer is collected, and the chloroform is removed by vacuum drying (40° C./24 hours) to prepare a sample.

Using this sample or the organosilicon polymer fine particles, the abundance ratios of the constituent compounds of the organosilicon polymer fine particle and the ratio of T3 unit structures in the organosilicon polymer fine particle are measured and calculated by solid $^{29}$Si-NMR.

In solid $^{29}$Si-NMR, peaks are detected in different shift regions according to the structures of the functional groups binding to the Si constituting the organosilicon polymer fine particles.

The structure binding to Si at each peak can be specified using a standard sample. The abundance ratio of each constituent compound can also be calculated from the resulting peak areas. The ratio of the peak area of T3 unit structures relative to the total peak area can also be determined by calculation.

The measurement conditions for solid $^{29}$Si-NMR are as follows for example.

Unit: JNM-ECX5002 (JEOL RESONANCE Inc.)

Temperature: Room temperature

Measurement method: DDMAS method, $^{29}$Si 45°

Sample tube: Zirconia 3.2 mm

Sample: Packed in sample tube in powder form

Sample rotation: 10 kHz

Relaxation delay: 180 s

Scan: 2,000

The hydrocarbon group represented by $R^a$ above is confirmed by $^{13}$C-NMR.

$^{13}$C-NMR (Solid) Measurement Conditions

Unit: JNM-ECX500II (JEOL RESONANCE Inc.)

Sample tube: 3.2 mm φ

Sample: Packed in sample tube in powder form

Sample temperature: Room temperature

Pulse mode: CP/MAS

Measurement nuclear frequency: 123.25 MHz ($^{13}$C)

Standard substance: Adamantane (external standard: 29.5 ppm)

Sample rotation: 20 kHz

Contact time: 2 ms

Delay time: 2 s

Number of integrations: 1024

In this method, the hydrocarbon group represented by $R^a$ above is confirmed based on the presence or absence of signals attributable to methyl groups (Si—$CH_3$), ethyl groups (Si—$C_2H_5$), propyl groups (Si—$C_3H_7$), butyl groups (Si—$C_4H_9$), pentyl groups (Si—$C_5H_{11}$), hexyl groups (Si—$C_6H_{13}$) or phenyl groups (Si—$C_6H_5$—) bound to silicon atoms.

After this measurement, the peaks of the multiple silane components having different substituents and linking groups in the organosilicon polymer fine particle are separated by curve fitting into the following X1, X2, X3 and X4 structures, and the respective peak areas are calculated.

The X3 structure below is the T3 unit structure according to the present invention.

X1 structure: $(Ri)(Rj)(Rk)SiO_{1/2}$ (A1)

X2 structure: $(Rg)(Rh)Si(O_{1/2})_2$ (A2)

X3 structure: $RmSi(O_{1/2})_3$ (A3)

X4 structure: $Si(O_{1/2})_4$ (A4)

X1:

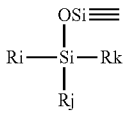

(A1)

X2:

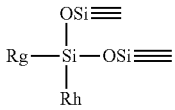

(A2)

X3:

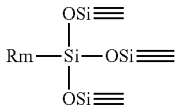

(A3)

X4:

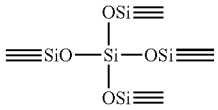

(A4)

Ri, Rj, Rk, Rg, Rh and Rm in formulae (A1), (A2) and (A3) represent halogen atoms, hydroxyl groups, acetoxy groups, alkoxy groups or organic groups such as $C_{1-6}$ hydrocarbon groups bound to silicon.

When a structure needs to be confirmed in more detail, it can be identified from $^{1}$H-NMR measurement results in addition to the above $^{13}$C-NMR and $^{29}$Si-NMR measurement results.

Method for Identifying Fatty Acid Metal Salt

The fatty acid metal salt can be identified by a combination of shape observation by scanning electron microscopy (SEM) and elemental analysis by energy dispersive X-ray analysis (EDS).

The toner is observed in a field enlarged to a maximum magnification of 50000× with a scanning electron microscope (trade name: "S-4800", Hitachi, Ltd.). The microscope is focused on the toner particle surface, and the external additive to be distinguished is observed. The external additive to be distinguished is subjected to EDS analysis, and the fatty acid metal salt can be identified based on the presence or absence of elemental peaks. The presence of a fatty acid metal salt can be deduced when an elemental peak is observed for a metal that may constitute the fatty acid metal salt, such as at least one metal selected from the group consisting of Mg, Zn, Ca, Al, Na and Li.

A standard sample of the fatty acid metal salt deduced from EDS analysis is prepared separately, and subjected to SEM shape observation and EDS analysis. The presence or absence of the fatty acid metal salt is then determined by seeing if the analysis results for the standard sample match the analysis results for the particle to be distinguished.

Method for Measuring Coverage Ratio of Fatty Acid Metal Salt Surface by Organosilicon polymer Fine Particle in Composite Particle The "coverage ratio of the fatty acid metal salt surface by the organosilicon polymer fine particle" in the composite particle is measured using a scanning electron microscope (trade name: "S-4800", Hitachi, Ltd.). Backscattered electron images of 100 randomly selected composite particles are taken in a field enlarged to a maximum magnification of 50000×. Because the contrast of a backscattered electron image differs depending on the composition of the substance, the organosilicon polymer fine particle and fatty acid metal salt exhibit different contrasts.

Based on the resulting backscattered electron images, the regions (area S1) of the organosilicon polymer fine particle and the regions (area S2) of the fatty acid metal salt in the composite particle are binarized to calculate their respective areas, and the ratio of the fatty acid metal salt covered by the organosilicon polymer fine particle is calculated by the formula S1/(S1+S2). The coverage ratio is calculated for the aforementioned 100 composite particles, and the arithmetic mean is given as the coverage ratio.

The ratio of composite particles with a coverage ratio of 1% to 40% in the total composite particles is also determined given the number of particles of the composite having this coverage ratio as the numerator, and the 100 observed composite particles as the denominator.

Method for Measuring Number-Average Particle Diameters of Primary Particles of Organosilicon Polymer Fine Particle and Fatty Acid Metal Salt The "number-average particle diameters of the primary particles of the organosilicon polymer fine particle and fatty acid metal salt" in the composite particle are measured with a scanning electron microscope (trade name: "S-4800", Hitachi, Ltd.). 100 randomly selected composite particles are photographed in a field enlarged to a maximum magnification of 50000×, 100 organosilicon polymer fine particles and fatty acid metal salt particles are selected randomly from the photographed images, and the number-average particle diameters are determined by measuring the long diameters of the primary particles. The observation magnification is adjusted appropriately according to the sizes of the organosilicon polymer fine particle and the fatty acid metal salt.

Method for Measuring Number-Average Particle Diameter of Composite Particle

The number-average particle diameter of the composite particle is measured with a scanning electron microscope (trade name: "S-4800", Hitachi, Ltd.). The long diameters of 100 randomly selected composite particles are measured in a field enlarged to a maximum magnification of 50000× to determine the number-average particle diameter. The observation magnification is adjusted appropriately according to the size of the composite particles.

Method for Measuring Number Ratio of Composite Particles in Toner Particles

The number ratio of the composite particles per one toner particle is measured by a combination of scanning electron microscopy (trade name: "S-4800", Hitachi, Ltd.) and elemental analysis by energy dispersive X-ray analysis (EDS). The toner including the composite particles is observed, and images are taken in 1000 random fields at a magnification of 1000×. Specifically, they are identified by the aforementioned method for identifying the composite particles comprising the fatty acid metal salt covered on the surface by the organosilicon polymer fine particle. The composite particles adhering to the toner are counted, and the number ratio is calculated relative to the number of toner particles counted in the same visual field.

Measuring Average Circularity of Toner

The average circularity of the toner is measured with a "FPIA-3000" flow particle image analyzer (Sysmex Corporation) under the measurement and analysis conditions for calibration operations.

The specific measurement methods are as follows.

About 20 mL of ion-exchange water from which solid impurities and the like have been removed is first placed in a glass container. About 0.2 mL of a dilute solution of "Contaminon N" (a 10 mass % aqueous solution of a pH 7 neutral detergent for washing precision instruments, comprising a nonionic surfactant, an anionic surfactant and an organic builder, manufactured by Wako Pure Chemical Industries, Ltd.) diluted 3-fold by mass with ion-exchange water is then added.

About 0.02 g of the measurement sample is then added and dispersed for 2 minutes with an ultrasonic disperser to obtain a dispersion for measurement. Cooling is performed as appropriate during this process so that the temperature of the dispersion is 10° C. to 40° C.

Using a tabletop ultrasonic cleaner and disperser having an oscillating frequency of 50 kHz and an electrical output of 150 W (for example, "VS-150" manufactured by Velvo-Clear), a specific amount of ion-exchange water s placed on the disperser tank, and about 2 mL of the Contaminon N is added to the tank.

A flow particle image analyzer equipped with a "LUCPLFLN" objective lens (magnification 20×, aperture 0.40) is used for measurement, with particle sheath "PSE-900A" (Sysmex Corporation) as the sheath liquid. The liquid dispersion obtained by the procedures above is introduced into the flow particle image analyzer, and 2000 toner particles are measured in HPF measurement mode, total count mode.

The average circularity of the toner is then determined with a binarization threshold of 85% during particle analysis, and with the analyzed particle diameters limited to equivalent circle diameters of at least 1.977 μm to less than 39.54 μm.

Prior to the start of measurement, autofocus adjustment is performed using standard latex particles (for example, Duke Scientific Corporation "RESEARCH AND TEST PAR- TICLES Latex Microsphere Suspensions 5100A" diluted with ion-exchange water). Autofocus adjustment is then performed again every two hours after the start of measurement.

Method for Measuring Weight-Average Particle Diameter (D4) of Toner

The weight-average particle diameter (D4) of the toner is calculated as follows. A "Multisizer (R) 3 Coulter Counter" precise particle size distribution analyzer (Beckman Coulter, Inc.) based on the pore electrical resistance method and equipped with a 100 μm aperture tube is used together with the accessory dedicated "Beckman Coulter Multisizer 3 Version 3.51" software (Beckman Coulter, Inc.) for setting measurement conditions and analyzing measurement data, and measurement is performed with 25000 effective measurement channels.

The aqueous electrolytic solution used in measurement may be a solution of special grade sodium chloride dissolved in ion-exchanged water to a concentration of about 1 mass %, such as "ISOTON II" (Beckman Coulter, Inc.) for example.

The following settings are performed on the dedicated software prior to measurement and analysis.

On the "Change standard measurement method (SOMME)" screen of the dedicated software, the total count number in control mode is set to 50000 particles, the number of measurements to 1, and the Kd value to a value obtained with "Standard particles 10.0 μm" (Beckman Coulter, Inc.). The threshold noise level is set automatically by pushing the "Threshold/noise level measurement" button. The current is set to 1600 μA, the gain to 2, and the electrolyte solution to ISOTON II, and a check is entered for "Aperture tube flush after measurement".

On the "Conversion settings from pulse to particle diameter" screen of the dedicated software, the bin interval is set to the logarithmic particle diameter, the particle diameter bins to 256, and the particle diameter range to 2 μm to 60 μm.

The specific measurement methods are as follows.

(1) About 200 ml of the aqueous electrolytic solution is added to a dedicated glass 250 ml round-bottomed beaker of the Multisizer 3, the beaker is set on the sample stand, and stirring is performed with a stirrer rod counter-clockwise at a rate of 24 rps. Contamination and bubbles in the aperture tube are then removed by the "Aperture flush" function of the dedicated software.

(2) 30 ml of the same aqueous electrolytic solution is placed in a glass 100 ml flat-bottomed beaker, and about 0.3 ml of a dilution of "Contaminon N" (a 10% by mass aqueous solution of a pH 7 neutral detergent for washing precision instruments, comprising a nonionic surfactant, an anionic surfactant, and an organic builder, manufactured by Wako Pure Chemical Industries, Ltd.) diluted 3-fold by mass with ion-exchange water is added.

(3) An ultrasonic disperser "Ultrasonic Dispersion System Tetra150" (Nikkaki Bios Co., Ltd.) is prepared with an electrical output of 120 W equipped with two built-in oscillators having an oscillating frequency of 50 kHz with their phases shifted by 180° from each other. About 3.3 l of ion-exchange water is added to the water tank of the ultrasonic disperser, and about 2 ml of Contaminon N is added to the tank.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolytic solution in the beaker.

(5) The aqueous electrolytic solution in the beaker of (4) above is exposed to ultrasound as about 10 mg of toner is added bit by bit to the aqueous electrolytic solution, and dispersed. Ultrasound dispersion is then continued for a further 60 seconds. During ultrasound dispersion, the water temperature in the tank is adjusted appropriately to from 10° C. to 40° C.

(6) The aqueous electrolytic solution of (5) above with the toner dispersed therein is dripped with a pipette into the round-bottomed beaker of (1) above set on the sample stand, and adjusted to a measurement concentration of about 5%. Measurement is then performed until the number of measured particles reaches 50000.

(7) The measurement data is analyzed with the dedicated software included with the apparatus, and the weight-average particle diameter (D4) is calculated. The weight-average particle diameter (D4) is the "Average diameter" on the "Analysis/volume statistical value (arithmetic mean)" screen when graph/volume % is set in the dedicated software.

Measuring Organosilicon polymer Fine Particle in Toner

When a silicon-containing substance other than the organosilicon polymer fine particle is included in the toner, 1 g of toner is dissolved in. 31 g of chloroform in a vial, and silicon-containing matter is dispersed away from the toner particle. Dispersion is performed for 30 minutes with an ultrasonic homogenizer to prepare a liquid dispersion.

Ultrasonic processing unit: VP-050 ultrasound homogenizer (Taitec Corporation)

Microchip: Step microchip, tip diameter φ 2 mm

Microchip tip position: Center of glass vial and 5 mm above bottom of vial

Ultrasound conditions: Intensity 30%, 30 minutes; ultrasound is applied while cooling the vial with ice water so that the temperature of the dispersion does not rise.

The dispersion is transferred to a swing rotor glass tube (50 mL), and centrifuged for 30 minutes under conditions of 58.33 $S^{-1}$ with a centrifuge (H-9R; Kokusan Co., Ltd.). After centrifugation, silica-containing material other than the organosilicon polymer fine particle is contained in the lower layer in the glass tube. The chloroform solution of the upper layer is collected, and the chloroform is removed by vacuum drying (40° C./24 hours).

This step is repeated to obtain 4 g of a dried sample. This is pelletized, and the silicon content is determined by fluorescence X-ray.

Fluorescence X-ray is performed in accordance with JIS K 0119-1969. Specifically, this is done as follows.

An "Axios" wavelength disperser fluorescence X-ray spectrometer (PANalytical) is used as the measurement unit with the accessory "SuperQ ver. 5.0L" dedicated software (PANalytical) for setting the measurement conditions and analyzing the measurement data. Rh is used for the anode of the X-ray tube and vacuum as the measurement atmosphere, and the measurement diameter (collimator mask diameter) is 27 mm.

Measurement is performed by the Omnian method in the range of elements F to U, and detection is performed with a proportional counter (PC) for light elements and a scintillation counter (SC) for heavy elements. The acceleration voltage and current value of the X-ray generator are set so as to obtain an output of 2.4 kW. For the measurement sample, 4 g of sample is placed in a dedicated aluminum pressing ring and smoothed flat, and then pressed for 60 seconds at 20 MPa with a "BRE-32" tablet compression molding machine (Maekawa Testing Machine Mfg. Co., Ltd.) to mold a pellet 2 mm thick and 39 mm in diameter.

Measurement is performed under the above conditions to identify each element based on its peak position in the resulting X-ray, and the mass ratio of each element is calculated from the count rate (unit: cps), which is the number of X-ray photons per unit time. For the analysis, the mass ratios of all elements contained in the sample are calculated by the FP assay method, and the content of silicon in the toner is determined. In the FP assay method, the balance is set according to the binder resin of the toner.

The content of the organosilicon polymer fine particle in the toner can be calculated from the silicon content of the toner as determined by fluorescence X-ray and the content ratio of silicon in the constituent compounds.

Measuring Content of Fatty Acid Metal Salt in Toner

The amount of the metal specified by the fatty acid metal salt identification method is measured using a wavelength disperser fluorescence X-ray spectrometer. Specifically, 4 g of the following toner is prepared and pelletized, and the content of the corresponding metal is determined by fluorescence X-ray.

The following operation is performed first to separate the metal to be measured into that derived from the fatty acid metal salt externally added to the toner and that derived from the toner particle itself. That is (1) the original toner, (2) toner that has been passed 5 times through a 38 μm (400 mesh) sieve, and (3) toner that has been passed 20 times through a 38 μm (400 mesh) sieve are prepared.

Passing the toner through the sieve serves to detach the fatty acid metal salt externally added to the toner, and the more times the toner is passed through the sieve, the more of the fatty acid metal salt is detached. This means that the amount of metal is less in (2) than in (1), and less in (3) than in (2). The amount of the metal (of the same kind as that of the fatty acid metal salt) not attributable to the externally added fatty acid metal salt can be specified by graphing and extrapolation. If the metal is only contained in the fatty acid metal salt, the amount can be calculated from only the measured value of (1).

Fluorescence X-ray measurement is performed in accordance with JIS K 0119-1969, specifically as follows.

An "Axios" wavelength disperser fluorescence X-ray spectrometer (PANalytical) is used as the measurement unit with the accessory "SuperQ ver. 5.0L" dedicated software (PANalytical) for setting the measurement conditions and analyzing the measurement data. Rh is used for the anode of the X-ray tube and vacuum for the measurement atmosphere, and the measurement diameter (collimator mask diameter) is 27 mm.

Measurement is performed by the Omnian method in the range of elements F to U, and detection is performed with a proportional counter (PC) for light elements and a scintillation counter (SC) for heavy elements. The acceleration voltage and current value of the X-ray generator are set so as to obtain an output of 2.4 kW. For the measurement sample, 4 g of the above toner sample is placed in a dedicated aluminum pressing ring and smoothed flat, and then pressed for 60 seconds at 20 MPa with a "BRE-32" tablet compression molding machine (Maekawa Testing Machine Mfg. Co., Ltd.) to mold a pellet 2 mm thick and 39 mm in diameter.

Measurement is performed under the above conditions to identify each element based on its peak position in the resulting X-ray, and the mass ratio of each element is calculated from the count rate (unit: cps), which is the number of X-ray photons per unit time.

For the analysis, the mass ratios of all elements contained in the sample are calculated by the FP assay method, and the content of the metal in the toner is determined. In the FP assay method, the balance is set according to the binder resin of the toner.

The metal in the toner as determined by fluorescence X-ray is graphed for (1), (2) and (3) above, given A as the assay value of (1), B as the assay value of (2) and C as the assay value of (3), with the ratio of each measured value to A plotted on the horizontal axis and the measured values plotted on the vertical axis. That is, the values are plotted as (horizontal, vertical axis)=(A/A=1, A), (B/A, B), (C/A, C). Correction can be done assuming that the intercept of the vertical axis represents a metal other than the fatty acid metal salt externally added to the toner.

The content of the fatty acid metal salt in the toner can be determined by considering the resulting measured amount of metal as the metal that is a principal metal component of the fatty acid metal salt such as a stearic acid metal salt.

EXAMPLES

The invention is explained in more detail below based on examples and comparative examples, but the invention is in no way limited to these. Unless otherwise specified, parts in the examples are based on mass.

Toner manufacturing examples are explained here.

Preparing Resin Particle Dispersion 89.5 parts of styrene, 9.2 parts of butyl acrylate, 1.3 parts of acrylic acid and 3.2 parts of n-lauryl mercaptane were mixed and dissolved. An aqueous solution of 1.5 parts of Neogen RK (DKS Co., Ltd.) in 150 parts of ion-exchange water was added and dispersed. This was then gently stirred for 10 minutes as an aqueous solution of 0.3 parts of potassium persfulate in 10 parts of ion-exchange water was added. After nitrogen purging, emulsion polymerization was performed for 6 hours at 70° C. After completion of polymerization, the reaction solution was cooled to room temperature, and ion-exchange water was added to obtain a resin particle dispersion with a median volume-based particle diameter of 0.2 μm and a solids concentration of 12.5 mass %.

Preparing Release Agent Dispersion 100 parts of a release agent (behenyl behenate, melting point 72.1° C.) and 15 parts of Neogen RK were mixed with 385 parts of ion-exchange water, and dispersed for about 1 hour with a wet type jet mill unit JN100 (Jokoh Co., Ltd.) to obtain a release agent dispersion. The solids concentration of the release agent dispersion was 20 mass %.

Preparation of Colorant Dispersion 100 parts of carbon black "Nipex35 (Orion Engineered Carbons)" and 15 parts of Neogen RK were mixed with 885 parts of ion-exchange water, and dispersed for about 1 hour in a wet type jet mill unit JN100 to obtain a colorant dispersion.

Preparation of Toner Particle 1

265 parts of the resin particle dispersion, 10 parts of the release agent dispersion and 10 parts of the colorant dispersion were dispersed with a homogenizer (Ultra-Turrax T50, IKA). The temperature inside the vessel was adjusted to 30° C. under stirring, and 1 mol/L hydrochloric acid was added to adjust the pH to 5.0. This was left for 3 minutes before initiating temperature rise, and the temperature was raised to 50° C. to produce aggregate particles. The particle diameter of the aggregate particles was measured under these conditions with a "Multisizer (R) 3 Coulter Counter" (Beckman Coulter, Inc.). Once the weight-average particle diameter reached 6.2 μm, 1 mol/L sodium hydroxide aqueous solution was added to adjust the pH to 8.0 and arrest particle growth.

The temperature was then raised to 95° C. to fuse and spheroidize the aggregate particles. Temperature lowering was initiated when the average circularity reached 0.980, and the temperature was lowered to 30° C. to obtain a toner particle dispersion 1.

Hydrochloric acid was added to adjust the pH of the resulting toner particle dispersion 1 to 1.5 or less, and the dispersion was stirred for 1 hour, left standing, and then subjected to solid-liquid separation in a pressure filter to obtain a toner cake. This was made into a slurry with ion-exchange water, re-dispersed, and subjected to solid-liquid separation in the previous filter unit. Re-slurrying and solid-liquid separation were repeated until the electrical conductivity of the filtrate was not more than 5.0 μS/cm, to ultimately obtain a solid-liquid separated toner cake.

The resulting toner cake was dried with a flash jet dryer (air dryer) (Seishin Enterprise Co., Ltd.). The drying conditions were a blowing temperature of 90° C. and a dryer outlet temperature of 40° C., with the toner cake supply speed adjusted according to the moisture content of the toner cake so that the outlet temperature did not deviate from 40° C. Fine and coarse powder was cut with a multi-division classifier using the Coanda effect, to obtain a toner particle 1. The toner particle 1 had a weight-average particle diameter (D4) of 6.3 μm, an average circularity of 0.980, and a Tg of 57° C.

Manufacturing Example of Organosilicon Polymer Fine Particle A1

Step 1

360 parts of water were placed in a reactor equipped with a stirrer, and 15 parts of 5.0 mass % hydrochloric acid were added to obtain a uniform solution. This was stirred at 25° C. as 136 parts of methyl trimethoxysilane were added and stirred for 5 hours, after which the mixture was filtered to obtain a clear reaction solution containing a silanol compound or a partial condensate thereof.

Step 2

440 parts of water were placed in a reactor equipped with a thermometer, a stirrer and a dripping mechanism, and 17 parts of 10.0 mass % ammonia water were added to obtain a uniform solution. This was stirred at 35° C. as 100 parts of the reaction solution obtained in Step 1 were dripped in over the course of 0.5 hours, and then stirred for 6 hours to obtain a suspension. The resulting suspension was centrifuged to precipitate and remove the particles, which were then dried for 24 hours in a drier at 200° C. to obtain an organosilicon polymer fine particle A1.

The number-average particle diameter of the primary particles of the resulting organosilicon polymer fine particle A1 was 100 nm.

Manufacturing Examples of Organosilicon Polymer Fine Particles A2 and A3

Organosilicon polymer fine particles A2 and A3 were obtained as in the manufacturing example of the organosilicon polymer fine particle A1 except that the silane compound, reaction initiation temperature, added amount of hydrochloric acid, added amount of ammonia water and dripping time were changed as shown in Table 1. The physical properties are shown in Table 1.

TABLE 1

| | Step 1 | | | | | | |
|---|---|---|---|---|---|---|---|
| Organosilicon polymer fine particle No. | Water Parts | Hydrochloric acid Parts | Reaction temperature ° C. | Silane compound A Name | Silane compound A Parts | Silane compound B Name | Silane compound B Parts |
| A1 | 360 | 15 | 25 | Methyl trimethoxysilane | 136 | | |
| A2 | 360 | 8 | 25 | Pentyl trimethoxysilane | 190.1 | Tripentyl methoxysilane | 3 |
| A3 | 360 | 23 | 25 | Methyl trimethoxysilane | 136 | | |

| | Step 2 | | | | | | |
|---|---|---|---|---|---|---|---|
| Organosilicon polymer fine particle No. | Reaction solution obtained in Step 1 Parts | Water Parts | Ammonia water Parts | Reaction initiation temperature ° C. | Dripping time hours | Number-average particle diameter of primary particles [nm] | T |
| A1 | 100 | 440 | 17 | 35 | 0.5 | 100 | 1.00 |
| A2 | 100 | 440 | 10 | 40 | 2 | 20 | 0.98 |
| A3 | 100 | 500 | 23 | 30 | 0.17 | 350 | 0.90 |

In the table, T represents the ratio of the area of peaks derived from silicon having a T3 unit structure to the total area of peaks derived from all silicon element.

Manufacturing Examples of Fatty Acid Metal Salts 1 to 3

A receiving container equipped with a stirrer was prepared, and the stirrer was rotated at 350 rpm. 500 parts of an 0.5 mass % aqueous solution of sodium stearate were placed in the receiving container, and the liquid temperature was adjusted to 85° C. 525 parts of an 0.2 mass % zinc sulfate aqueous solution were then dripped into the receiving container over the course of 15 minutes. After completion of all additions, this was cured for 10 minutes at the same temperature as the reaction, and the reaction was ended.

The fatty acid metal salt slurry thus obtained was filtered and washed. The resulting washed fatty acid metal salt cake was crushed, and dried at 105° C. with a continuous instantaneous air dryer. This was then pulverized with a Nano Grinding Mill NJ-300 (Sunrex Industry Co., Ltd.) with an air flow of 6.0 $m^3$/min at a processing speed of 80 kg/h. This was re-slurried, and fine and coarse particles were removed with a wet centrifuge. This was then dried at 80° C. with a continuous instantaneous air drier to obtain a dried fatty acid metal salt.

Three kinds of zinc stearate B1 to B3 with different particle diameters adjusted by air classification were obtained as fatty acid metal salts. The particle diameters are shown in Table 2.

TABLE 2

| Fatty acid metal salt | Number-average particle diameter (μm) |
|---|---|
| Zinc stearate B1 | 0.7 |
| Zinc stearate B2 | 0.3 |
| Zinc stearate B3 | 1.5 |

Manufacturing Example of Composite Particle 1

The organosilicon polymer fine particle A1 and fatty acid metal salt B1 were mixed in a 500 ml glass container in the proportions shown in Table 3, and mixed for 1 minute at an output of 450 W with a blender mixer (Oster) to obtain a composite particle 1.

Manufacturing Examples of Composite Particles 2 to 17

Composite particles 2 to 17 were obtained as in the manufacturing example of the composite particle 1 except that the conditions shown in Table 3 were changed in the manufacturing example of the composite particle 1.

Manufacturing Example of Composite Particle 18

A composite particle 18 was obtained as in the manufacturing example of the composite particle 1 except that 5 parts of sol-gel silica with a particle diameter of 110 nm (X24-9600A: Shin-Etsu Chemical Co., Ltd.) were used instead of the 5 parts of the organosilicon polymer fine particle A1.

TABLE 3

| Composite particle No. | Organosilicon polymer fine particle | | | Fatty acid metal salt | | | Particle | |
|---|---|---|---|---|---|---|---|---|
| | No. | Particle diameter (nm) | Parts | No. | Particle diameter (nm) | Parts | diameter ratio A/B | Parts ratio C/D |
| 1 | A 1 | 100 | 5.0 | B 1 | 700 | 0.30 | 0.14 | 0.06 |
| 2 | A 1 | 100 | 1.0 | B 1 | 700 | 0.30 | 0.14 | 0.30 |
| 3 | A 1 | 100 | 8.0 | B 1 | 700 | 0.30 | 0.14 | 0.04 |
| 4 | A 1 | 100 | 1.5 | B 1 | 700 | 0.05 | 0.14 | 0.03 |
| 5 | A 1 | 100 | 10.0 | B 1 | 700 | 1.00 | 0.14 | 0.10 |
| 6 | A 2 | 20 | 1.0 | B 1 | 700 | 0.30 | 0.03 | 0.30 |
| 7 | A 3 | 350 | 5.0 | B 1 | 700 | 0.30 | 0.50 | 0.06 |
| 8 | A 1 | 100 | 5.0 | B 2 | 300 | 0.30 | 0.33 | 0.06 |
| 9 | A 2 | 20 | 1.0 | B 3 | 1500 | 0.30 | 0.01 | 0.30 |
| 10 | A 1 | 100 | 5.0 | B 3 | 1500 | 0.30 | 0.07 | 0.06 |
| 11 | A 3 | 350 | 5.0 | B 3 | 1500 | 0.30 | 0.23 | 0.06 |
| 12 | A 1 | 100 | 0.5 | B 1 | 700 | 0.05 | 0.14 | 0.10 |
| 13 | A 1 | 100 | 10.0 | B 1 | 700 | 0.05 | 0.14 | 0.005 |
| 14 | A 1 | 100 | 0.2 | B 1 | 700 | 0.50 | 0.14 | 2.50 |
| 15 | A 1 | 100 | 15.0 | B 1 | 700 | 0.50 | 0.14 | 0.03 |
| 16 | A 1 | 100 | 3.0 | B 1 | 700 | 0.03 | 0.14 | 0.01 |
| 17 | A 1 | 100 | 5.0 | B 1 | 700 | 2.50 | 0.14 | 0.50 |
| 18 | Silica | 100 | 5.0 | B 1 | 700 | 0.30 | 0.14 | 0.06 |

Manufacturing Example of Toner 1

External Addition Step

The composite particle 1 in the parts shown in Table 4 was added to the toner particle 1 (100 parts) obtained above with an FM mixer (Nippon Coke & Engineering Co., Ltd. FM10C) with 7° C. water in the jacket.

Once the water temperature in the jacket had stabilized at 7° C.±1° C., this was mixed for 5 minutes with a 38 m/sec peripheral speed of the rotating blade, to obtain a toner mixture 1.

The amount of water passing through the jacket was adjusted appropriately during this process so that the temperature in the FM mixer tank did not exceed 25° C.

The resulting toner mixture 1 was sieved with a 75 μm mesh sieve to obtain a toner 1.

The manufacturing conditions and physical properties of the toner 1 are shown in Table 4. The coverage ratio of the fatty acid metal salt surface by the organosilicon polymer fine particle, the number-average particle diameter of the composite particle and the number ratio of the composite particle relative to the toner particle were also measured in the resulting toners. The results are shown in Table 4.

Preparation Examples of Toners 2 to 17 and Comparative Toners 1 to 4

Toners 2 to 17 and comparative toners 1 to 4 were obtained as in the manufacturing example of the toner 1 except that the conditions were changed as shown in Table 4. The physical properties are shown in Table 4.

TABLE 4

| Example No. | Toner No. | External addition conditions | | | | Physical properties of composite particle | | |
|---|---|---|---|---|---|---|---|---|
| | | Additive 1 | Parts | Additive 2 | Parts | Coverage ratio by organosilicon polymer fine particle | Ratio of composite particles with coverage ratio of 1% to 40% | Number ratio of composite particles to toner particles |
| 1 | 1 | Composite particle 1 | 5.3 | — | — | 20% | 92% | 0.05 |
| 2 | 2 | Composite particle 2 | 1.3 | — | — | 3% | 90% | 0.05 |
| 3 | 3 | Composite particle 3 | 8.3 | — | — | 37% | 86% | 0.05 |

TABLE 4-continued

| Example No. | Toner No. | External addition conditions: Additive 1 | Parts | Additive 2 | Parts | Physical properties of composite particle: Coverage ratio by organosilicon polymer fine particle | Ratio of composite particles with coverage ratio of 1% to 40% | Number ratio of composite particles to toner particles |
|---|---|---|---|---|---|---|---|---|
| 4 | 4 | Composite particle 4 | 1.6 | — | — | 38% | 90% | 0.001 |
| 5 | 5 | Composite particle 5 | 11.00 | — | — | 15% | 99% | 0.9 |
| 6 | 6 | Composite particle 6 | 1.3 | — | — | 25% | 92% | 0.05 |
| 7 | 7 | Composite particle 7 | 5.3 | — | — | 1% | 90% | 0.05 |
| 8 | 8 | Composite particle 8 | 5.3 | — | — | 2% | 88% | 0.1 |
| 9 | 9 | Composite particle 9 | 1.3 | — | — | 39% | 86% | 0.05 |
| 10 | 10 | Composite particle 10 | 5.3 | — | — | 38% | 85% | 0.01 |
| 11 | 11 | Composite particle 11 | 5.3 | — | — | 14% | 85% | 0.01 |
| 12 | 12 | Composite particle 12 | 0.6 | — | — | 12% | 99% | 0.001 |
| 13 | 13 | Composite particle 13 | 10.1 | — | — | 48% | 65% | 0.001 |
| 14 | 14 | Composite particle 14 | 0.7 | — | — | 1% | 3% | 0.05 |
| 15 | 15 | Composite particle 15 | 15.5 | | | 35% | 87% | 0.05 |
| 16 | 16 | Composite particle 16 | 3.0 | — | — | 37% | 92% | 0.01 |
| 17 | 17 | Composite particle 17 | 7.5 | — | — | 1% | 87% | 2 |
| C.E. 1 | Comparative 1 | Composite particle 18 | 5.3 | — | — | 25% | 82% | 0.05 |
| C.E. 2 | Comparative 2 | Organosilicon polymer fine particle A1 | 5.0 | Zinc stearate B1 | 0.3 | 0% | 0% | 0.000 |
| C.E. 3 | Comparative 3 | Zinc stearate B1 | 0.3 | — | — | — | — | — |
| C.E. 4 | Comparative 4 | Organosilicon polymer fine particle A1 | 5.0 | — | — | — | — | — |

In the table, "C.E." denotes "comparative example".

Example 1

The toner 1 was evaluated as follows. The evaluation results are shown in Table 5.

A modified LBP712Ci (Canon Inc.) was used as the evaluation unit. The cartridge was modified to change the linear pressure of the cleaning blade to 8.0 kgf/m. When the linear pressure is high, untransferred toner and external additives remaining between the photosensitive drum and the cleaning blade are pressed more strongly against the photosensitive drum, causing melt adhesion of toner and external additives to the photosensitive drum and promoting wear of the photosensitive drum from the external additives, so this is a severe evaluation for startup streaks and vertical streaks. The necessary adjustments were made to allow image formation under these conditions. The toner was removed from the black cartridge, which was filled instead with 300 g of the toner 1 for the evaluation.

Image Evaluation

Startup Streak Evaluation (Evaluating Toner and External Additive Cleaning Performance)

An endurance test was performed in a normal temperature, normal humidity environment (23° C., 60% RH) by printing 30000 sheets in total of a horizontal line image with a print percentage of 2% on every other sheet (and with the printer rotation stopped for 3 seconds between every printed sheet). Canon Color Laser Copier paper (A4: 81.4 g/m$^2$, also used below unless otherwise specified) was used as the evaluation paper. The degree of streaking was evaluated by outputting a halftone image as an image sample. Evaluations were performed on the following morning after endurance testing of 1000 sheets, 5000 sheets and 30000 sheets. The evaluation standard is as follows. An evaluation of C or more is considered good.

Evaluation Standard

A: No startup streaks

B: Only slight startup streaks

C: Startup streaks seen on some images

D: Quality of image declined due to streaking

Following the above startup streak evaluation after endurance testing of 30000 sheets, the unit was left for a further 10 days, a half-tone image was output, and the degree of streaking was evaluated. Since the external additive and toner between the cleaning blade and the photosensitive drum are under pressure when left after endurance testing, which promotes melt adhesion to the photosensitive drum, so this is a severe evaluation for startup streaks. The evaluation standard is as follows. An evaluation of C or more is considered good.

Evaluation Standard

A: No startup streaks

B: Only slight startup streaks

C: Startup streaks seen on some images

D: Quality of image declined due to streaking

Vertical Streak Evaluation (Evaluating Wear to Latent Image Bearing Member from External Additive)

An endurance test was performed in a low temperature, low humidity environment (15° C., 10% RH) by printing 30000 sheets of a horizontal line image with a print percentage of 2% on every other sheet (and with the printer rotation stopped for 3 seconds between every printed sheet). A halftone image was then output, and the occurrence of vertical streaks due to uneven wear of the photosensitive drum was evaluated in the resulting image. The evaluation standard is as follows. An evaluation of C or more is considered good.

Evaluation Standard

A: No vertical streaks

B: Only slight vertical streaks

C: Vertical streaks seen on some images

D: Quality of image declined due to streaking

Evaluating Contamination of Member (Evaluating Contamination of Member by External Additive)

30000 sheets of an image with a print percentage of 0.2% were output in a low temperature, low humidity environment (15° C., 10% RH) with a two-second interval between each 2 sheets. The charging roller was then removed from the toner cartridge. The charging roller was removed from a new (commercial) process cartridge, the charging roller from endurance testing was attached, and a halftone image was output. The uniformity of the halftone image was evaluated visually, and contamination of the charging member was evaluated.

It is known that when the charging member is contaminated, charging irregularities occur on the photosensitive drum, causing density irregularities in the halftone image. An evaluation of C or more is considered good.

Evaluation Standard

A: Image density uniform, without irregularities

B: Some irregularity in image density

C: Image density somewhat irregular, but still good

D: Image density irregular, uniform halftone image not obtained

Examples 2 to 17, Comparative Examples 1 to 4

These were evaluated as in Example 1. The evaluation results are shown in Table 5.

TABLE 5

| Example No. | Toner No. | Startup streaks After 1000 sheets | Startup streaks After 5000 sheets | Startup streaks After 30000 sheets | Startup streaks After 10 days standing | Vertical streaks After 30000 sheets | Contamination of the member After 30000 sheets |
|---|---|---|---|---|---|---|---|
| 1 | 1 | A | A | A | A | A | A |
| 2 | 2 | C | B | B | C | A | B |
| 3 | 3 | A | A | A | A | A | B |
| 4 | 4 | C | C | B | C | A | B |
| 5 | 5 | A | A | A | A | A | B |
| 6 | 6 | B | B | B | B | A | B |
| 7 | 7 | B | B | B | B | A | B |
| 8 | 8 | B | B | A | B | A | B |
| 9 | 9 | C | B | B | C | A | C |
| 10 | 10 | B | B | B | B | A | B |
| 11 | 11 | C | B | B | C | A | C |
| 12 | 12 | B | B | B | C | A | A |
| 13 | 13 | B | B | B | B | A | C |
| 14 | 14 | C | C | C | C | A | A |
| 15 | 15 | C | C | C | C | A | C |
| 16 | 16 | C | C | C | C | A | C |
| 17 | 17 | C | C | C | C | A | C |
| C.E. 1 | Comparative 1 | B | B | C | D | D | D |
| C.E. 2 | Comparative 2 | D | D | C | D | A | D |
| C.E. 3 | Comparative 3 | C | C | C | D | A | D |
| C.E. 4 | Comparative 4 | C | C | C | D | A | D |

In the table, "C.E." denotes "comparative example".

Good results were obtained in Examples 1 to 17 in all evaluation categories. In Comparative Examples 1 to 4, on the other hand, the results were inferior to those of the example in some evaluation categories.

These results show that with the toner according to the invention, no startup streaks occur due to slippage of external additives and toner through the cleaning blade even during cartridge startup, no vertical streaks occur due to wear of the latent image bearing member during long term use, and contamination of the member by external additives is prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-247162, filed Dec. 28, 2018, and Japanese Patent Application No. 2019-204194, filed Nov. 11, 2019, which are hereby incorporated by reference herein in their entirety.

What is claimed is:

1. A toner comprising:

a toner particle containing a binder resin, and an external additive containing composite particles, wherein said composite particles comprise an organosilicon polymer fine particle and a fatty acid metal salt.

2. The toner according to claim 1, wherein when the composite particle is observed under a scanning electron microscope, 70 to 100 number % of the total composite particles have a coverage ratio of a surface of the fatty acid metal salt by the organosilicon polymer fine particle of 1 to 40% by area.

3. The toner according to claim 1, wherein a number ratio of the composite particles is 0.001 to 1.000 per one particle of the toner particle.

4. The toner according to claim 1, wherein a content of the organosilicon polymer fine particle is 0.5 to 10.0 mass parts per 100 mass parts of the toner particle, and a content of the fatty acid metal salt is 0.05 to 1.0 mass part per 100 mass parts of the toner particle.

5. The toner according to claim 1, wherein primary particles of the organosilicon polymer fine particle have a number-average particle diameter of 0.02 to 0.35 μm, and primary particles of the fatty acid metal salt have a number-average particle diameter of 0.15 to 2.0 μm.

6. The toner according to claim 1, wherein the organosilicon polymer fine particle has a structure of alternately bonded silicon atoms and oxygen atoms, and part of the organosilicon polymer has a T3 unit structure represented by $R^aSiO_{3/2}$, where $R^a$ represents a $C_{1-6}$ alkyl group or phenyl group, and a ratio of area of a peak derived from silicon having the T3 unit structure relative to a total area of peaks derived from all silicon elements contained in the organosilicon polymer fine particle is 0.50 to 1.00 in $^{29}$Si-NMR measurement of the organosilicon polymer fine particle.

7. The toner according to claim 1, wherein the fatty acid metal salt includes zinc stearate.

8. A method of manufacturing the toner according to claim 1, comprising the steps of:

mixing the organosilicon polymer fine particle with the fatty acid metal salt to obtain the composite particles, and externally adding the composite particles to the toner particle.

* * * * *